US008569952B2

(12) United States Patent
Genz

(10) Patent No.: US 8,569,952 B2
(45) Date of Patent: Oct. 29, 2013

(54) CERAMIC METAL HALIDE LAMP HAVING A HIGH COLOR TEMPERATURE

(75) Inventor: Andreas Genz, Berlin (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 164 days.

(21) Appl. No.: 13/127,498

(22) PCT Filed: Oct. 26, 2009

(86) PCT No.: PCT/EP2009/064032
§ 371 (c)(1),
(2), (4) Date: May 4, 2011

(87) PCT Pub. No.: WO2010/052142
PCT Pub. Date: May 14, 2010

(65) Prior Publication Data

US 2011/0204776 A1 Aug. 25, 2011

(30) Foreign Application Priority Data

Nov. 6, 2008 (DE) ..... 10 2008 056 173

(51) Int. Cl.
*H01J 17/20* (2012.01)
*H01J 61/20* (2006.01)

(52) U.S. Cl.
USPC ..... 313/641

(58) Field of Classification Search
None
See application file for complete search history.

(56) References Cited

U.S. PATENT DOCUMENTS

| | | | | |
|---|---|---|---|---|
| 5,323,085 | A | 6/1994 | Genz | |
| 7,486,026 | B2 | 2/2009 | Johnston et al. | |
| 2003/0020408 | A1 | 1/2003 | Higashi et al. | |
| 2004/0189212 | A1 | 9/2004 | Ashida et al. | |
| 2009/0302784 | A1 * | 12/2009 | Franke et al. | 313/638 |
| 2010/0213867 | A1 | 8/2010 | Kaening et al. | |

FOREIGN PATENT DOCUMENTS

| | | | |
|---|---|---|---|
| EP | 0492205 | B1 | 7/1992 |
| EP | 1153415 | B1 | 1/2007 |
| JP | 51086281 | A | 7/1976 |
| JP | 51086281 | U | 7/1976 |
| JP | 2003086132 | A | 3/2003 |
| JP | 2010509733 | A | 3/2010 |
| WO | 0143163 | A1 | 6/2001 |
| WO | 2008038245 | A2 | 4/2008 |
| WO | 2008129486 | A2 | 10/2008 |
| WO | 2009010088 | A1 | 1/2009 |

OTHER PUBLICATIONS

English translation of JP 51086281 A.
English translation of JP 5108628 U.
English abstract of JP2003086132A; Mar. 20, 2003.

* cited by examiner

*Primary Examiner* — Britt D Hanley

(57) ABSTRACT

In various embodiments, a high-pressure discharge lamp is provided. The high-pressure discharge lamp may include a ceramic discharge vessel which encloses a discharge volume, wherein a filling containing sodium halides, rare earth halides, mercury and inert gas is accommodated in the discharge volume, wherein the filling at the same time includes the rare earths Tm and Gd, the relative proportions between Gd and Tm, considered as a molar ratio, lying in the range 0.1 to 1.

11 Claims, 2 Drawing Sheets

CERAMIC METAL HALIDE LAMP HAVING A HIGH COLOR TEMPERATURE

RELATED APPLICATIONS

The present application is a national stage entry according to 35 U.S.C. §371 of PCT application No.: PCT/EP2009/064032 filed on Oct. 26, 2009, which claims priority from German application No.: 10 2008 056 173.8 filed on Nov. 6, 2008.

TECHNICAL FIELD

Various embodiments relate to a high-pressure discharge lamp. Lamps of this type are e.g. high-pressure discharge lamps having a ceramic discharge vessel or quartz glass vessel for general lighting.

BACKGROUND

EP 1 153 415B1 discloses a high-pressure discharge lamp in which a metal halide filling is used. The high-pressure discharge lamp uses a filling composed of Na or Li together with Hg and TbJ3. The color temperature lies in the daylight range between 4825 and 7070 K. The CRI is in the range of 87 to 93. Efficiency is only 61 to 76 lm/W. Also cited therein is JP 51-086281, which uses NaJ, GdJ3 and TlJ together with Hg and Ar.

SUMMARY

Various embodiments provide a high-pressure discharge lamp with metal halide filling which achieves a color temperature in the daylight range of at least 5000 K.

According to the invention a filling for the luminous perceived color daylight, preferably 5500 to 6500 K, is now employed which uses halides of Na and Tm as well as Gd as metal halides.

The discharge vessel consists of ceramic. The aspect ratio (internal length/internal diameter) preferably lies between 2 and 8. Inert gas, preferably xenon or argon having a pressure between 50 and 500 hPa, is used (cold) as the filling gas. In general an inert gas mixture having only or mainly xenon can also preferably be used. Xenon provides somewhat more light yield than argon as a result of lower heat losses (about 1 to 3 lm/W), but is more expensive than argon.

The wall load measured in the area between the electrodes lies preferably between 20 and 40 W/cm$^2$.

The filling includes proportions of sodium and rare earths (REs) as metal halides. At least Tm and Gd are used as rare earths. In this case the molar ratio between Gd and Tm lies between 0.1 and 1, particularly preferably between 0.2 and 0.8. The molar ratio between the sum of all rare earths and sodium lies preferably between 0.2 and 5, particularly preferably between 0.3 and 3. Pr and/or Ho are also suitable as additional REs, the proportion of the total amount of RE amounting to max. 10 mol % in each case.

The filling can also include In and Tl. It is particularly preferred for 2 to 20 mol % of the filling to be In.

Iodine and/or bromine are used as halogens. Particularly preferably the molar percentage of bromine is less than 50%.

The color temperature lies in the daylight range starting from 5000 K, preferably 5500 to 6500 K. With the metal halide filling according to the invention the color rendering index is greater than 80 and the light yield is in excess of 90 lm/W.

The inventive concept is suitable primarily for low-power lamps in the range from 15 to 400 W.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
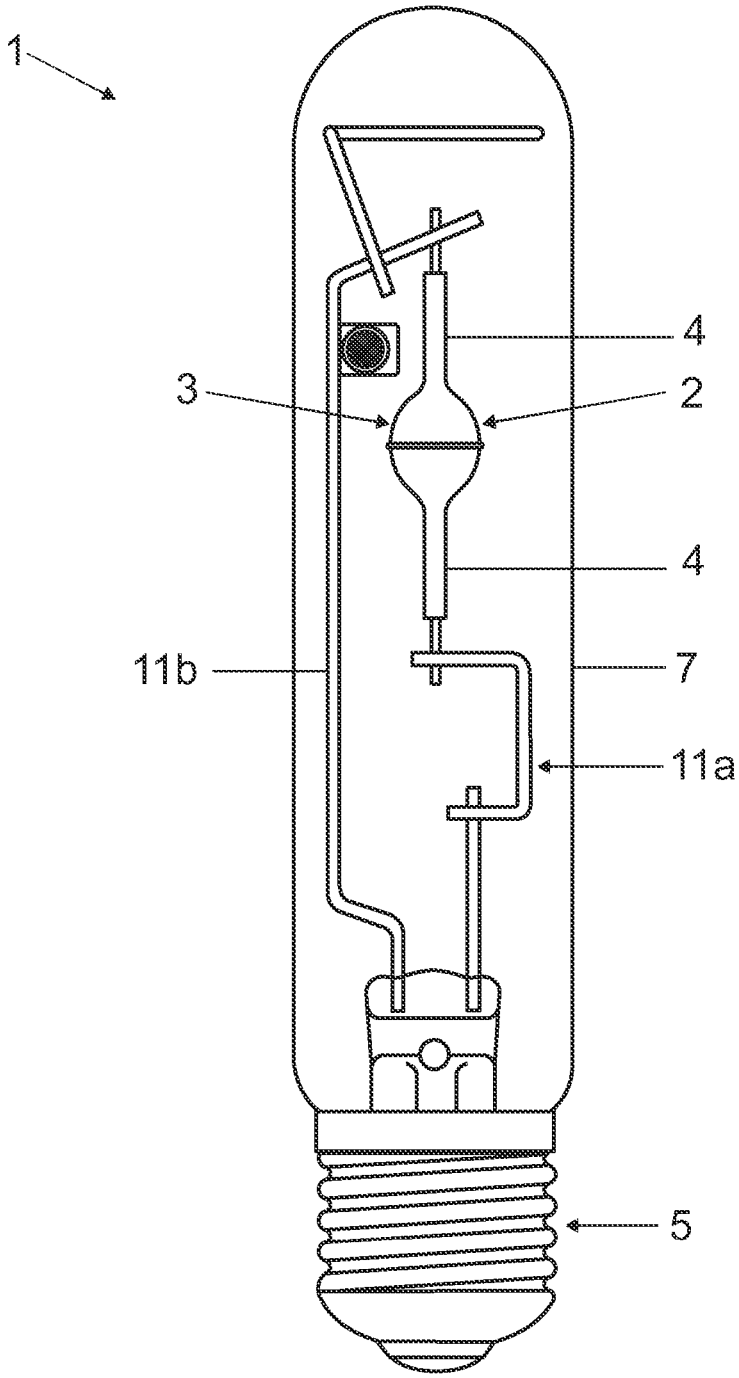
FIG. 1 shows a high-pressure discharge lamp with discharge vessel.

FIG. 1 schematically shows a metal halide lamp 1. It consists of a discharge vessel 2 made of ceramic, into which two electrodes (not shown) are introduced. The discharge vessel has a central part 3 and two ends 4 with feedthroughs as known per se. The discharge volume has an aspect ratio of 5.

The discharge vessel 2 is surrounded by an outer bulb 7. The discharge vessel 2 is retained in the outer bulb by means of a frame which contains a short and a long current feed 11*a* and 11*b* and is sealed by means of a screw base 5.

The discharge vessel contains a filling which typically comprises Hg (1 to 10 mg/cm$^3$) and 5 to 50 mg/cm$^3$ iodides of Tm, Tl, Na, In and Gd. Xenon is used cold under a pressure of 250 hPa as the inert gas.

The exact dosage is shown in Tab. 1.

| Component | Wt. % |
|---|---|
| TmJ3 | 46.4 |
| TlJ | 5.8 |
| NaJ | 19.6 |
| InJ | 5 |
| GdJ3 | 23.2 |

This results in the following characteristic data for the lamp:

| | 100 h values |
|---|---|
| Color temperature | 6000K |
| Lighting current | 6705 lm |
| Color rendering | 81 |
| Light yield | 92 lm/W |
| Lamp voltage | 100 V |
| Power output | 73 W |

With this filling, TlJ and InJ can be dispensed with where appropriate. Possible additives in terms of RE metals are also Ho and Pr.

Figure 2:
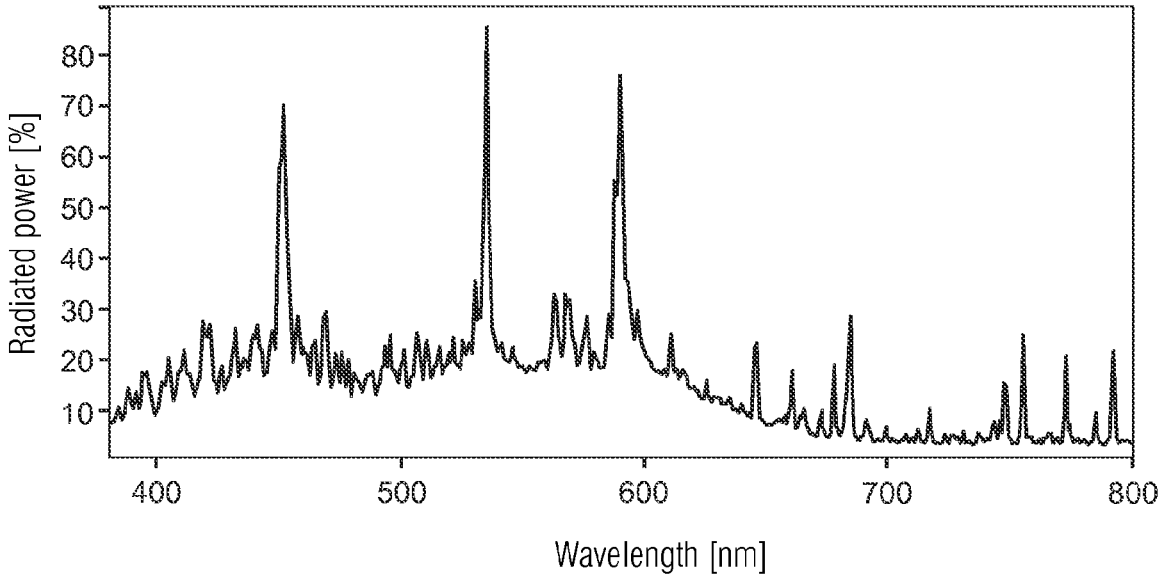
FIG. 2 shows a spectrum of the lamp from FIG. 1.

A spectrum of a lamp of this kind is shown in FIG. 2, where the relative radiated power is plotted against the wavelength. The spectrum yields an x value of 0.323 and a y value of 0.343 for the chromaticity coordinate. The color temperature is 5950 K. The color rendering index Ra is 81. The light yield is 91.5 lm/W.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A high-pressure discharge lamp, comprising:

a ceramic discharge vessel or a quartz glass vessel which encloses a discharge volume, wherein a filling containing sodium halides, rare earth halides, mercury and inert gas is accommodated in the discharge volume, wherein the filling at the same time includes the rare earths Tm and Gd, the relative proportions between Gd and Tm, considered as a molar ratio, lying in the range 0.1 to 1 wherein the color temperature is in the range from 5950 k to 6500 k.

2. The high-pressure discharge lamp as claimed in claim 1, wherein the relative proportions lie between 0.2 and 0.8, marginal values included.

3. The high-pressure discharge lamp as claimed in claim 1, wherein the halide is at least one of iodine and bromine, and wherein at least one of xenon and argon is used as the inert gas.

4. The high-pressure discharge lamp as claimed in claim 1, wherein the metal halides additionally have at least one of Ho and Pr as rare earths, each at max. 10 mol %.

5. The high-pressure discharge lamp as claimed in claim 1, wherein halides of at least one of In and TI are used in addition as metal halides.

6. The high-pressure discharge lamp as claimed in claim 1, wherein the content of Hg is in the range of 1 to 20 mg/cm3.

7. The high-pressure discharge lamp as claimed in claim 1, wherein the molar ratio between the sum of all rare earths and Na is in the range 0.2 to 5.

8. The high-pressure discharge lamp as claimed in claim 1, wherein the lamp has a color rendering index of at least 80.

9. The high-pressure discharge lamp as claimed in claim 1, wherein the lamp has a light yield of at least 90 lm/W.

10. The high-pressure discharge lamp as claimed in claim 3, wherein the halide is at least one of iodine and bromine with max. 50 mol % bromine.

11. The high-pressure discharge lamp as claimed in claim 7, wherein the molar ratio between the sum of all rare earths and Na is in the range 0.3 to 3.

* * * * *